United States Patent [19]

Corzilius et al.

[11] Patent Number: 4,586,872

[45] Date of Patent: May 6, 1986

[54] CENTRIFUGAL PUMP

[75] Inventors: Rolf Corzilius, Dortmund; Horst-Guenter Noack, Maria-Veen; Johann Stollbrink, Lembeck, all of Fed. Rep. of Germany

[73] Assignee: Klöckner-Humboldt-Deutz AG, Fed. Rep. of Germany

[21] Appl. No.: 558,838

[22] Filed: Dec. 7, 1983

[30] Foreign Application Priority Data

Dec. 24, 1982 [DE] Fed. Rep. of Germany ..... 3247937
Sep. 26, 1983 [DE] Fed. Rep. of Germany ..... 3334786

[51] Int. Cl.[4] ..... F04D 29/42
[52] U.S. Cl. ..... 415/219 C
[58] Field of Search ..... 415/219 C, 219 R, 219 A, 415/170 A, 196, 197, DIG. 3

[56] References Cited

U.S. PATENT DOCUMENTS

| | | | |
|---|---|---|---|
| 2,450,671 | 10/1948 | Loss | 415/219 C |
| 3,249,057 | 5/1966 | Callahan | 415/219 C |
| 3,776,660 | 12/1973 | Anderson et al. | 415/219 C X |
| 3,841,791 | 10/1974 | Doolin | 415/170 A |
| 4,218,181 | 8/1980 | Komatsu et al. | 415/219 C X |

FOREIGN PATENT DOCUMENTS 2719168 10/1970 Fed. Rep. of Germany .

OTHER PUBLICATIONS

KHD brochure entitled "Kreiselpumpen, Bauart Ropu 9-609" dated Jan. 1977.
KHD brochure entitled "Standard Ccentrifugal Pumps with Liner Walls", Model W as per DIN 24252, estimated date 5/1977 or earlier.
KHD brochure entitled "Viele Bauen Chemie-Kreiselpumpen Wir Bauen Pumpen fur die Verschiedensten Einsatzzwecke", estimated date 5/1977 or earlier.
KHD brochure entitled "Armoured Centrifugal Pumps Model SP" estimated date 5/1977 or earlier.

*Primary Examiner*—Robert E. Garrett
*Assistant Examiner*—Joseph M. Pitko
*Attorney, Agent, or Firm*—Hill, Van Santen, Steadman & Simpson

[57] ABSTRACT

In a centrifugal pump, particularly for conveying tailing water in dressing plants for minerals such as coal, as for flue gas desulfuration systems or the like, a spiral housing is clamped between two retainer plates which externally connect to parallel wear walls without being bolted thereto. The retainer plates are designed as a two-piece, externally screw-connected enclosure for a hydraulics portion of the pump. The spiral housing is connected with the external screw-connection over retaining lugs. The enclosure parts are designed as flat retainer plates having a smooth clamping face for the spiral housing and the wear walls, and exhibit feet that have been welded on.

24 Claims, 1 Drawing Figure

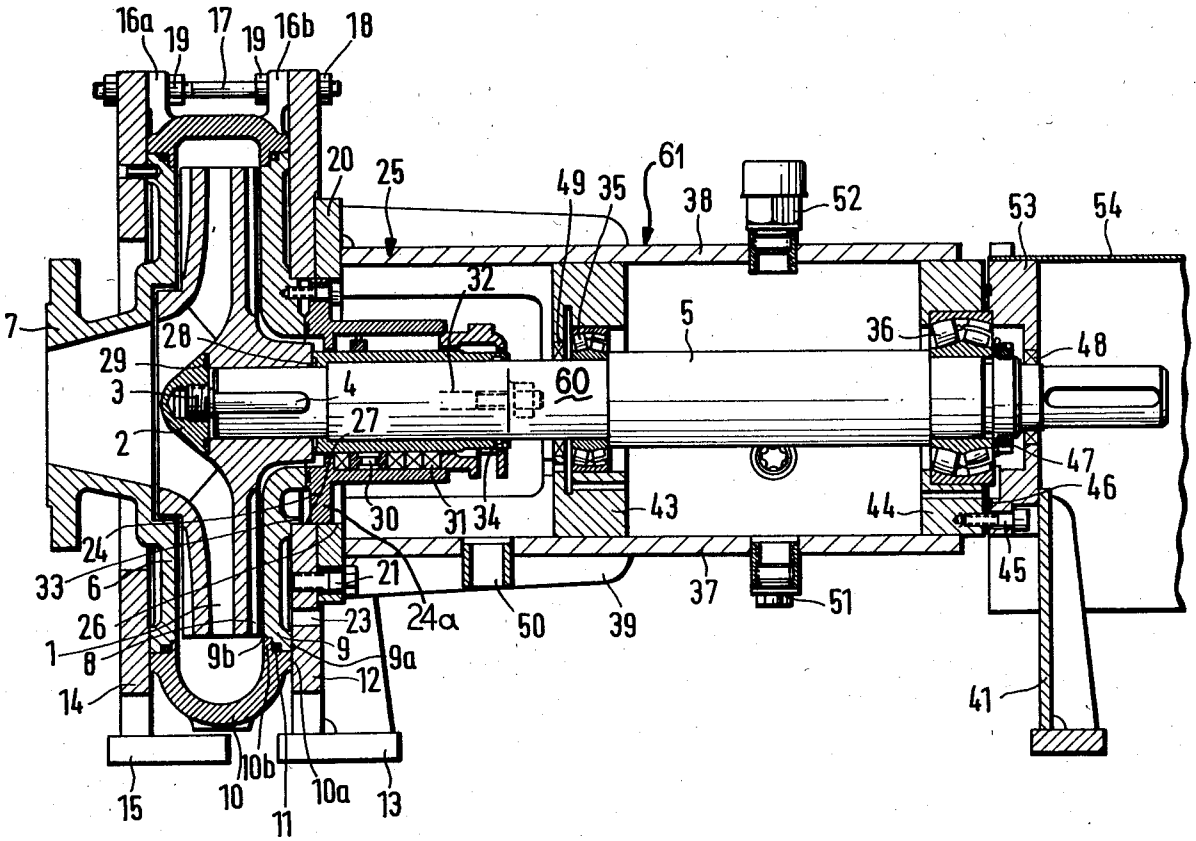
54
53
48
47
46
45
41
36
44
52
51
38
37
5
61
43
39
35
49
60
50
32
34
31
24a
25
30
21
9a
13
18
20
4
27
23
9
12
10a
16b
19
11
17
10b
10
9b
28
16a
29
3
2
24
6
26
8
15
33
1
14
7

CENTRIFUGAL PUMP

BACKGROUND OF THE INVENTION

The invention relates to a centrifugal pump, particularly for conveying tailing water in dressing systems for minerals such as coal in flue gas desulfuration systems or the like etc. An over-hung wheel, rotor or impeller has a shaft sealed at a driving back-side via a seal inside a shaft seal sleeve. The shaft is seated in two rolling bearings. A spiral housing for the rotor is provided along with wear walls and a retaining structure.

Pumps of the type described above are employed for conveying solids pump in dressing systems for minerals, in flue gas desulfuration systems, etc. A known pump of this type is disclosed, for example, in German OS No. 27 19 168, incorporated herein by reference.

SUMMARY OF THE INVENTION

An object of the invention is to specify a pump which exhibits retaining plates previously known for the spiral housing hydraulics portion but is more lightly constructed and cheaper to manufacture than the known pump. It is also an object of the invention to specify the design of a pump wherein the rotor or impeller can be dismounted without disconnecting suction and/or pressure connectors, i.e. the rotor should be optionally removable at the front or back without dismantling the spiral housing.

According to the invention, the pump retaining plates are designed as a two piece enclosure for the spiral housing hydraulics portion. It is thus advantageously possible to design the pump to be light in weight overall and to dismount the rotor without having to move the spiral housing. Given removal of the rotor toward the front inlet side or back-side, a pressure joint thus need not be disconnected.

In a further development of the invention, the rotor shaft is seated in a bearing flange comprised of two shell portions designed as a welded structure. A substantial costreduction over the known pump thus results for a bearing flange housing which supports the back-side retainer plate.

In another development of the invention the bearing flange housing exhibits an end flange that is connected to the back-side retainer plate of the enclosure by means of a screw-type connection. For the purpose of dismounting the rotor at the back side, thus it is easily possible to separate the bearing flange housing from the enclosure formed by the retainer plates by means of loosening a few screws.

In a further development of the invention the end flange has an inside aperture that has a same diameter as an inside aperture of the back-side retainer plate of the enclosure so that a shared retaining flange that preferably forms a part of the shaft seal sleeve is disposed in the inside apertures of the enclosure retaining plate and of the end flange. An optimum connection of bearing flange housing and enclosure is thus possible with a faultless guidance of the two parts relative to one another, and the possibility of a fast dismantling of the bearing flange by simply loosening screws in order to be able to remove the rotor at the back also results. A faultless central guidance of the rotor shaft in the bearing flange housing and through the back-side retainer plate of the enclosure is thus insured during operation.

In another development of the invention an inlet or suction side wear wall has an inlet suction joint preferably designed as an inlet diffusor and forming a single casting. A simpler design of the suction or inlet side of the pump thus results in comparison to the known design. Assembly times are reduced, as are the number of piece parts and the weight.

In a further development of the invention the enclosure retainer plates are designed as flat plates with a smooth clamping face for the spiral housing and the wear walls. Particularly cost-favorable, smooth retainer plates thus result.

In a further development of the invention the back-side wear wall has an integrally cast ring that engages into the inside aperture of the back-side retainer plate of the enclosure. A simple, reliable centering of the back-side wear wall thus results which also advantageously enables the spiral housing to be held in centered fashion between the enclosure parts via this wear wall at the bearing flange housing side.

In another development of the invention the spiral housing is held by the enclosure parts via smooth clamping faces. This technique produces a particularly simple design of the enclosure parts which results in a very cost-favorable manufacture of the centrifugal pump according to the invention.

In another development of the invention, the spiral housing has retaining lugs which are preferably integrally cast and which are directed radially outwardly. Via the retaining lugs, it becomes possible to simply screw the spiral housing and the enclosure parts to one another from the outside. The spiral housing is held in position as long as at least one enclosure part (retainer plate) remains in position, so that a fast and simple reassembly of the removed parts is possible.

In a further development of the invention the wear walls have an outside ring-like indentation into which corresponding rings of the spiral housing engage. A good, laterally guided connection of the wear walls to the spiral housing thus results without the system of module-like connectability of the individual parts of the centrifugal pump according to the invention being lost.

In another development of the invention, a seal, particularly in the form of a covered O-ring, is disposed in the radial indentation or depression of the wear walls. A particularly favorable, simple sealing of the spiral housing thus results which is certain to prevent an emergency of the conveyed fluid exteriorly despite the fact that the spiral housing is only clamped. The seal is completely protected as a result of the design according to the invention and is not abrasively loaded.

In a further development of the invention the wear walls and the spiral housing have bearing shoulders which fix the spiral housing for seating against the enclosure retainer plates. This technique also serves advantageously for easy and fast assembly combined with low manufacturing costs.

In another development of the invention the rotor has long back vanes. A relief of the rotor shaft seal thus results. The conveyed fluid is nearly unpressurized in the area of the rotor shaft, and a suction effect at the stuffing box can even be achieved.

In a further development of the invention the enclosure retainer plates are screwed to one another in a known manner by means of bolts exterior to the spiral housing. A particularly simple assembly and/or dismantling of the front and back enclosure retainer plates, the spiral housing, and the wear walls thus results. It is thus of particular advantage that the retaining lugs of the spiral housing can also be connected to the enclosure retainer plates with the same bolts.

In a further development of the invention the pump exhibits a clutch protecting sleeve. This improves upon the number of uses to which the pump may be put.

BRIEF DESCRIPTION OF THE DRAWING

The drawing FIGURE illustrates in cross-section a design of the centrifugal pump according to the invention.

DESCRIPTION OF THE PREFERRED EMBODIMENTS

In the drawing, 1 indicates the rotor or impeller with the back vanes 8. The rotor is slipped in over-hung manner onto the shaft 5. A key 4 insures transmission of torque. The rotor or impeller 1 is held in the center by the shaft nut 2 that is screwed onto the shaft butt 3 provided with a nut. A seal 29, preferably an O-ring, is positioned behind the shaft nut 2 so that fluid cannot penetrate past the shaft nut into the area between the shaft 5 and the rotor or impeller 1.

The spiral housing 10 with the retaining lugs **16*a* and 16*b* exteriorly extends around the rotor 1. Two or a multiple of two retaining lugs are provided and these lugs are slipped onto the retaining bolts 17. The retaining bolts 17 that normally only have outside nuts 18 have an extended thread in each case for mounting the lugs 16*a* and 16*b* so that it is possible to fasten the spiral housing to enclosure retaining plates 12, 14 via the bolts 17 and the retaining lugs 16*a* and 16*b* with the nuts 19**.

The wear walls 6 and 9 are disposed at both sides of the rotor or impeller 1. The suction or inlet-side wear wall 6 is integrally connected to the diffusor 7 and is pinned to the retainer plate 14 which has the shape of a flat plate with a foot welded thereon. The back-side wear wall 9 has a projecting ring 33 which engages in an inside aperture of the retainer plate 12.

O-ring seals 11 are provided between the spiral housing 10 and the wear walls 6 and 9. The O-rings prevent the conveyed fluid from emerging through the gap between the wear walls 6 and 9 and the spiral housing 10. The seal is provided in a completely protected manner in hollows, but it nonetheless allows an easy and simple assembly and dismantling of the wear walls and of the spiral housing. The retainer plates 12 and 14 have feet 13 and 15 so that the enclosure retainer plates of the centrifugal pump according to the invention can be easily and simply connected to a foundation via bores (not illustrated).

The retaining plate 12 is connected via the screws 21 to an end flange 20 exhibiting the same inside diameter 26 as the back-side retainer plate 12 so that a mutual centering occurs via a flange **24*a* on a shaft protecting sleeve 24. The end flange 20 is rigidly connected to halfshells 37 and 38 (forming a shaft seal sleeve 25) so that these three elements 20, 37,and 38 form a bearing flange housing 61, and effects the centering of this bearing flange housing 61 relative to the back-side retainer plate 12**.

The wear wall 9 has seals 27 at the bearing flange housing side at an inside edge, these likewise being preferably designed as O-rings and preventing fluid from emerging between the wear wall 9 and the shaft seal sleeve 25 or the like.

A further O-ring seal 28 provides sealing at the back side of the rotor or impeller 1 relative to the shaft 5. Sealing of the shaft 5 relative to the bearings 35 and 36 occurs either via packings 31 and the ring 30 (as in the seal shown below the shaft) or, as shown below the shaft 5, with an axial face seal 26. The seals are disposed on a shaft protecting sleeve 24. Given employment of packings, tie bolts 32 are employed, these acting on the stuffing box collar plate 60 with an integrated splash-proof enclosure.

A connector 50 is provided for the elimination of potential leakage water. Reinforcing angles 39, which firmly connect the two half-shells 37 and 38 to the end flange 20, serve for stiffening and for connection to the end flange 20.

The shaft 5 runs in the bearings 35 and 36 which are preferably designed as self-aligning roller bearings. The bearings 35 and 36 are sealed via oil seals 48 and 49.

The two halfshells 37 and 38 (which form the shaft seal sleeve 25) exhibit the filling apertures 51 and 52 via which the bearing flange housing 61 can be filled or emptied. At the drive side, the bearing 36 is fixed via the shaft nut 47 which outwardly covers the bearing cap 53. This is screwed to the bearing flange housing 61 by means of screws 45.

Although the pump according to the invention already has a reliable placement by screws at the feed 13 and 15, it preferably has another auxiliary foot 41 that is rigidly welded to the bearing cap 53. It is thus assured that the feet 13 and 15 and the auxiliary foot 41 align in fault-free fashion. A particularly stable design of the pump according to the invention thus results, further enabling standardized foundation dimensions to be utilized.

The ability for two-sided dismounting of the rotor wheel or impeller can be clearly seen in the drawing. Should removal toward the front, i.e. at the suction side, be necessary, the suction line is first undone, the front retainer plate 14 is then removed, and the diffusor 7 with the front wear wall 6 is taken off toward the front. After loosening the shaft nut 2, the rotor wheel or impeller can be turned off of the rotor shaft 5 and removed. Given removal toward the back-side, the screws 17 are first loosened, whereupon the complete bearing flange housing 61 with the back retainer plate 12, the wear wall 9, and the rotor 1 with the runner shaft 5 can be pulled from the spiral housing 10 which still remains firmly attached to the front retainer plate 14 with the foot 15. Releasing the suction line is thus not necessary nor is a release of the pressure line at the spiral housing 10.

The pump according to the invention is specifically designed for conveying media with a light solids load in coal washing plants, for ore mining, and for flue gas desulfuration systems. Without departing from the framework of the invention, however, it can also be employed for all other solids-charged media or even for clean water.

Although various minor changes and modifications might be proposed by those skilled in the art, it will be understood that we wish to include within the claims of the patent warranted hereon all such changes and modifications as reasonably come within our contribution to the art.

We claim as our invention:

1. A centrifugal pump, comprising:

a rotor mounted on a rotor shaft;

roller bearing means for supporting said shaft;

a bearing flange housing surrounding the shaft and containing the rolling bearings therein supporting the shaft;

a spiral housing for the rotor which, together with parallel wear walls radially abutting the spiral housing, enclose the rotor;

a two-piece enclosure for the spiral housing and wear walls comprising inlet side and back-side retaining plates;

means for pulling the retaining plates toward one another so as to create a clamping action to retain the parallel wear walls and spiral housing in bolt-free connecting abutment with one another;

said back-side retaining plate having an inside aperture, and a shaft protection sleeve surrounding the shaft and positioned in said aperture;

said bearing flange housing having an end flange and an aperture in said end flange; and said shaft protection sleeve having means for aligning said back-side retaining plate with said bearing flange by an abutting cooperation with an inside edge wall of the apertures of the end flange and back-side retaining plate.

2. A centrifugal pump according to claim 1 wherein the bearing flange housing is formed of two shell parts welded together.

3. A centrifugal pump according to claim 2 wherein the bearing flange housing end flange directly connects with abutting flush surfaces to the back-side retaining plate by screws.

4. A centrifugal pump according to claim 3 wherein the end flange inside aperture has substantially a same diameter as the inside aperture in the back-side retainer plate.

5. A centrifugal pump according to claim 4 wherein said shaft protection sleeve has a shared radial flange dimensioned to be received within and abut against said inside aperture of the bearing flange housing end flange and the inside aperture of the back-side retaining plate.

6. A centrifugal pump according to claim 1 wherein the inside wear wall has a suction inlet all formed as a single casting.

7. A centrifugal pump according to claim 1 wherein both retaining plates are designed as flat plates having a smooth clamping face for the spiral housing and for the wear walls.

8. A centrifugal pump according to claim 1 wherein the wear wall at the back side has an integrally projecting ring that engages in abutting contact into said inside aperture of the back-side retainer plate.

9. A centrifugal pump according to claim 1 wherein the spiral housing is held between the retainer plates at smooth clamping faces.

10. A centrifugal pump according to claim 1 wherein the spiral housing has retaining lugs extending radially outwardly.

11. A centrifugal pump according to claim 1 wherein each of the wear walls has a radially outward circular indentation or depression into which corresponding rings of the spiral housing engage.

12. A centrifugal pump according to claim 11 wherein an O-ring seal is provided at the circular indentation of the wear walls.

13. A centrifugal pump according to claim 1 wherein the wear walls in the spiral housing have bearing shoulders for abutment against inside surfaces of the retaining plates.

14. A centrifugal pump according to claim 1 wherein the rotor has long back vanes.

15. A centrifugal pump according to claim 1 wherein the retainer plates are screwed to one another by bolts exteriorly of the spiral housing so as to clamp the spiral housing therebetween.

16. A centrifugal pump according to claim 1 wherein a clutch protection sleeve is provided at an end of the bearing flange housing opposite the end flange.

17. A centrifugal pump for conveying fluids, comprising:

a rotor mounted on a shaft;

a bearing flange housing containing the shaft and having bearings therein supporting the shaft;

said bearing flange housing having an end flange;

inlet side and back-side wear walls between which the rotor is positioned;

a spiral housing surrounding and in abutting screw-free connection contact with an outer periphery of the wear walls;

inlet side and back-side retainer plates pulled together by screw means for clamping the spiral housing and wear walls therebetween such that the spiral housing is in abutting screw-free connection with the wear walls;

said end flange being bolted to said back-side retainer plate; and first support foot means projecting downwardly from the inlet side retainer plate and second support foot means projecting downwardly from said back-side retainer plate for independently supporting the inlet side retainer plate during removal of the back side retainer plate and vice-versa.

18. The pump of claim 17 wherein the spiral housing has projecting retaining lug means permitting removal of the inlet side or back-side retainer plate while permitting the spiral housing to remain attached to the respective retainer plate which is not removed.

19. The pump of claim 17 wherein the end flange is directly bolted flush to the back-side retainer plate.

20. A pump according to claim 17 wherein the bearing flange housing at an end opposite the end flange has auxiliary foot means which in conjunction with the second support foot means holds in position and aligns the back-side retainer plate relative to the inlet side retainer plate.

21. A pump according to claim 17 wherein the back-side wear wall has a ring engageable and supportable in an inside aperture of the back-side retainer plate.

22. The pump according to claim 17 wherein the bearing flange housing has a plurality of reinforcing angles connecting to the end flange and running perpendicularly therefrom in connection with the flange housing.

23. A centrifugal pump, comprising:

a rotor mounted on a rotor shaft;

roller bearing means for supporting said shaft;

a bearing flange housing surrounding the shaft and containing the roller bearing means therein supporting the shaft;

a spiral housing with retaining lug means and parallel wear walls radially abutting the spiral housing surrounding the rotor;

a two-piece enclosure for the spiral housing and wear walls comprising inlet side and back-side retainer plates;

bolt means passing through the retainer lug means for pulling the retainer plates toward one another so as to create a clamping action to retain the parallel wear walls and spiral housing in bolt-free connecting abutment with one another;

the inlet side retainer plate and back-side retainer plate each having their own foot supporting means for independently supporting either retainer plate given removal of the other plate; and said retaining lug means holding the spiral housing to either retainer plate given removal of the other retainer plate.

24. A pump according to claim 23 wherein the bearing flange housing has an end flange in direct and flush contact with the back-side retainer plate and wherein the bearing flange housing has an additional foot means at an end opposite of the end flange for supporting the end flange housing and back-side retainer plate given removal of the inlet side retaining plate.

* * * * *